United States Patent [19]

Buhrer

[11] 4,114,675

[45] Sep. 19, 1978

[54] METHOD AND APPARATUS FOR POURING A MOLD WITH A SELECTABLE AMOUNT OF CASTING MATERIAL

[76] Inventor: Erwin Bührer, Vögelingässchen 40, Schaffhausen, Switzerland

[21] Appl. No.: 776,912

[22] Filed: Mar. 11, 1977

[30] Foreign Application Priority Data

Mar. 15, 1976 [CH] Switzerland ..... 3169/76

[51] Int. Cl.[2] ..... B22C 19/04

[52] U.S. Cl. ..... 164/4; 164/155

[58] Field of Search ..... 164/4, 337, 154, 155, 164/156

[56] References Cited

U.S. PATENT DOCUMENTS

| | | | |
|---|---|---|---|
| 2,882,567 | 4/1959 | Deakins | 164/4 UX |
| 3,599,835 | 8/1971 | Kocks | 164/155 UX |
| 3,842,894 | 10/1974 | Southworth | 164/154 X |

*Primary Examiner*—Francis S. Husar
*Assistant Examiner*—John S. Brown
*Attorney, Agent, or Firm*—Toren, McGeady and Stanger

[57] ABSTRACT

The amount of liquid metal casting material poured into a mold from a receptacle located above the mold from pouring means in the bottom of the receptacle is controlled by continuously sensing the pressure head of the liquid metal casting material in the receptacle during pouring of the mold, numerically integrating to a constant value the product of the multiplication of a function of the pressure head and time, and controlling the pouring means to terminate the pouring of the mold when a predetermined set value is attained. Electronic control circuitry receives as an input signal a signal representing the pressure head of the liquid casting material within the receptacle and a control function is effected by the electronic control means to stop pouring when a selected predetermined amount of material has been introduced into a mold. The quantity of casting material poured into a filled mold is sensed and a feedback signal is provided to adjust the control function when the amount of casting material in the filled mold is found to deviate from a desired amount. Furthermore the electronic control circuitry may be equipped with a mechanism to sense variations in the rate of flow of the pouring device and to adjust for changes.

13 Claims, 8 Drawing Figures

METHOD AND APPARATUS FOR POURING A MOLD WITH A SELECTABLE AMOUNT OF CASTING MATERIAL

BACKGROUND OF THE INVENTION

The present invention relates generally to pouring of casting molds and more particularly to a method and apparatus whereby molds may be poured with a selectable amount of liquid metal casting material. Generally, the invention is applied in a pouring facility where the selectable amount of liquid metal is poured into molds from a tank or receptacle located above the molds and having a pouring device in the bottom thereof which generally comprises at least one closeable bottom opening.

In the pouring of casting molds with liquid metal, the metal yield, which may be generally defined as the weight ratio between the liquid metal casting material poured into the mold and the crude castings, is influenced by the accuracy with which the quantity of liquid metal casting material may be determined before or during the casting operation.

The determination of the quantity of liquid casting material per mold to be cast, both before or during the casting operation, will also give rise to the further advantage that the casting operation may be fully performed to utilize all the available casting material since overcasting will be permanently prevented by the quantitative determination with consideration of the holding capacity of the mold.

In the prior art, and particularly from Swiss Pat. No. 320,832, there is known a casting method wherein a predetermined amount of liquid metal, which may be necessary for filling the mold, is applied into a ladle, with this ladle being emptied during the pouring operation. In order to effectuate this method, a balance is applied to this ladle by means of which the amount or quantity of the liquid metal casting material which is fed to the ladle from a collecting vessel may be determined.

The aforementioned method has the disadvantage that the liquid metal must first be filled into the ladle and, after the quantitative determination, must be again transferred during the pouring operation. This second pouring step results not only in an increased slag formation thus clogging the discharge spout, but it also produces a considerable temperature loss in the liquid metal casting material. Furthermore, during stoppages which are unavoidable in a foundry, the ladle is normally filled with the liquid metal to be cast and considerable cooling of the liquid metal occurs during such stoppages. Because of this, the liquid metal becomes unusable for casting in the mold and must be discarded into a sand bed which is provided for this purpose.

Other prior art approaches, such as those involved in Swiss Pat. Nos. 528,318 and 551,243, disclose a method for controlled pouring of casting material into a mold where the amount of liquid metal required for casting the mold is determined by first weighing the mold, including the parts cooperating with the mold before the casting, and then completing the pouring of the mold after an additional predetermined metal weight exceeding the first weight has been attained. This method has the disadvantage that, when the mold is in the casting or weighing position, vibrations will be produced and the weight of the mold to be cast may therefore only be determined accurately after these vibrations have stopped. However, since the casting time is short in any event, this additional reduction of the casting time leads to an inaccurate quantitative determination.

If a break occurs in the casting material during the casting of a mold in the partial plane of the mold, the casting operation can only be completed at the end of the casting time by a safety switch, since the balance does not stop the casting operation because the casting weight is not attained.

A further disadvantage resides in the fact that pressure cells used for weight measurements are harmfully stressed in the horizontal direction when a mold moves in and out of a weighing position and they cannot be properly protected against contamination. In the two possibilities mentioned above for determining the amount of liquid there is involved an additional disadvantage in that the required equipment is mechanically complicated and desired safety factors are difficult to achieve when handling the liquid metal. The equipment also requires extraordinary maintenance and the maintenance work must be performed by specially trained workers.

The present invention eliminates many of the aforementioned disadvantages in that an approach is provided whereby certain problems arising in prior art arrangements are eliminated.

SUMMARY OF THE INVENTION

In the present invention, pouring of the molds is formed by locating a liquid metal receptacle over molds to be poured with a bottom opening being provided in the liquid metal receptacle which may be opened and closed to effectuate pouring of the mold. The pressure head of the liquid metal above the outlet opening is determined, and the product of the multiplication of a function of this pressure head by the time and a constant value is numerically integrated and the bottom opening is closed when a set value is attained.

In order to further increase the accuracy of the quantitative determination effected by the invention, it is provided that the square root of the pressure head be utilized as the function of the latter.

In order to cope with variations in the discharge opening during operation of the pouring apparatus, which variations may occur as a result of erosion or slag deposits, the height of a riser in a poured mold is measured and deviations occurring therein from a given height generate a signal which is used to correct the set value for casting a subsequent mold.

The invention also comprises an arrangement wherein means are provided for determining the pressure head, and additionally, there are provided means for transmitting the pressure head signal to an electronic control which includes a start-stop logic, a voltage frequency transducer, a memory register, a counter and a detector.

In order to increase the accuracy of the quantitative determination, and also to obtain a liquid metal jet which is free from unwanted spray, the bottom opening is tapered toward the lower part thereof and is formed preferably with the smallest cross section at the outlet end of the opening.

Further increases in the accuracy of the quantitative determintion may be effected by an electric switch which is provided which is capable of being actuated by lifting a plug for opening and closing the bottom opening which can then impart the start signal to the start-stop logic.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 1:
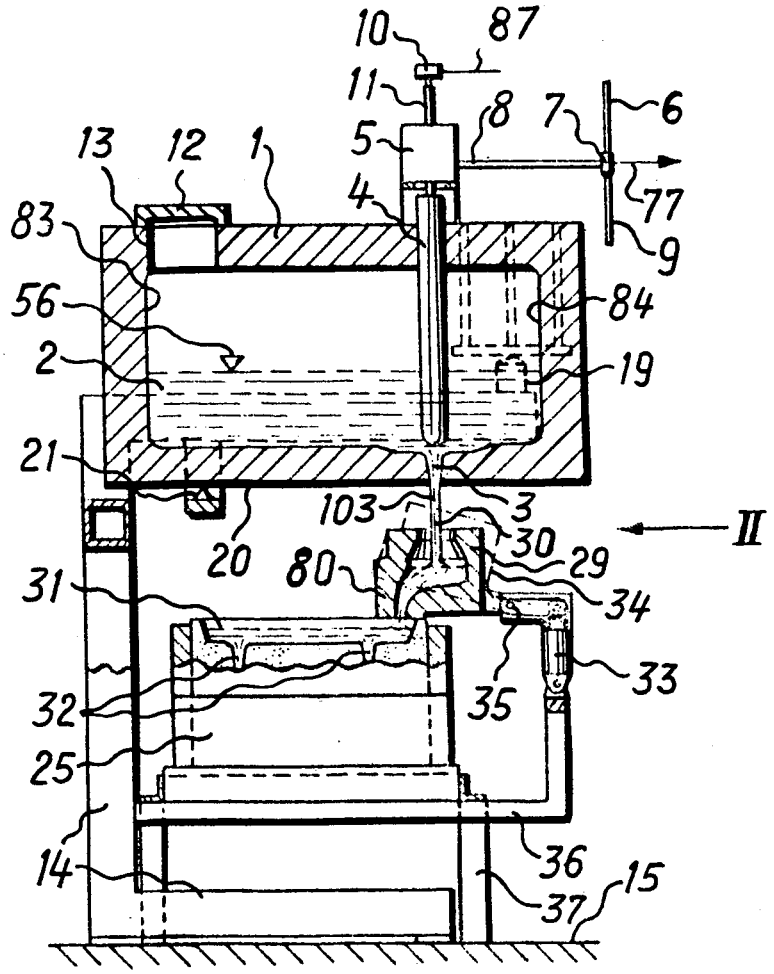
FIG. 1 is a sectional view of an apparatus in accordance with the present invention, with the view being taken along a line I—I in FIG. 2.

Referring now to the drawings wherein like reference numerals refer to similar parts throughout the various figures thereof, an apparatus employing the present invention is shown as comprising a receptacle or tank 1 which contains liquid metal casting material 2 and includes pouring means comprising a bottom opening 3 which may be opened and closed by a plug member 4. In the preferred form of the invention, the inner walls 83, 84, 85 and 86 of the receptacle 1 are formed to be parallel with each other so that the weight of the liquid metal within the receptacle will rise proportionally to the filling height when the latter is determined by a weighing operation.

The bottom opening 3 is formed so as to taper toward the lower end thereof and it is preferably arranged at the discharge end 104 to have the smallest cross section. In this way, a defined bottleneck for determining pressure head is provided and a compact liquid metal jet 103 may be obtained.

Lifting gear 5 for raising and lowering the operating plug 4 is provided which is capable of receiving in a known manner, disclosed in Swiss Pat. No. 320,382, compressed air through a pressure line 6, an electromagnetic valve 7 and a line 8. As a result, the plug 4 may be raised into the position shown in FIG. 1 by operation of the valve 7 and by reversing the valve 7, to connect line 8 with an exhaust pipe 9, the plug may be lowered into the position shown in FIGS. 2 and 3 and the bottom opening may be thus closed.

An electric switch 10 is provided at a location above a bar 11 rigidly connected with the plug 4. When the bottom opening 3 opens by raising plug 4, bar 11 will actuate the switch 10 as shown in FIG. 1. When the plug 4 is lowered in the position indicated in FIG. 2, the electric switch 10 will again be released.

Figure 4:
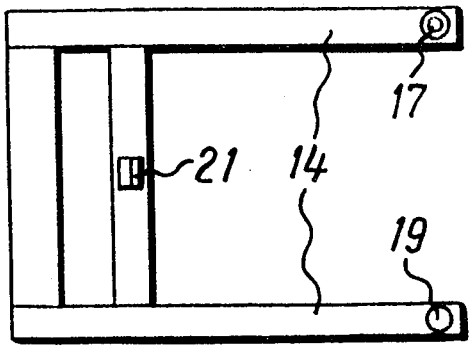
FIG. 4 is a top view of a support for the liquid metal receptacle utilizing the apparatus of the present invention with the receptacle removed from the support.

A filling hole 13 connected to a cover 12 operates to allow liquid metal 2 to be filled into the tank or receptacle 1. The tank 1 is supported upon a floor surface 15 by means of a supporting construction 14 which is shown in FIG. 1 and also shown in FIG. 4. The tank 1 includes a tank flange 16 which bears upon a support 17. The tank also includes a flange 18 which bears upon a pressure cell 19, with the bottom 20 of the tank being supported by a support member 21. Thus, it will be seen that the support arrangement of the present invention essentially provides a three-point support which is illustrated in FIG. 4 and which thereby ensures that the pressure cell 19 will receive as a load force which is proportional to the weight corresponding to the total weight of the tank 1 including the liquid metal 2.

It is advantageous to locate and arrange the support member 21 relative to the filling hole 13 so that the support 21 is located directly under the liquid metal jet which is formed during the filling or refilling of the tank 1. In this manner, the measured value of the pressure cell will remain uninfluenced by the momentum or force of the jet pressure when the tank 1 is refilled.

The apparatus of the invention is designed so that molds which are to be poured may be successively moved into positions beneath the tank 1. In the drawings, and with particular reference to FIG. 2, a mold 25 is shown in the pouring position below the tank 1. Additionally, a mold 22 is shown in the position just prior to the pouring position and a filled or poured mold 26 is shown after having been passed from the pouring position with all of the molds being arranged for conveying upon a roll-out or conveyor table 27. The mold 25 in the casting position receives liquid metal 30 through a pouring spout 29 which defines a passage through which the metal may be made to flow from the tank 1 into an upper trough 31 and from there into a series of through gates 32 and subsequently into the cavity of mold 25. The pouring spout 29 is arranged so that it will bear upon the top of the mold 25 during the pouring operation. After pouring is completed, the spout 29 may be tilted about a rotary shaft 35 and it will thus be lifted off the top of the mold 25 by means of a reversing gear (not shown) of a cylinder 33 and it will be brought into a position labelled 34. A beam 36 supports the rotary shaft 35 and cylinder 33 by means of a support structure 37 of the conveyor table 27 upon a floor surface 15.

Figure 7:
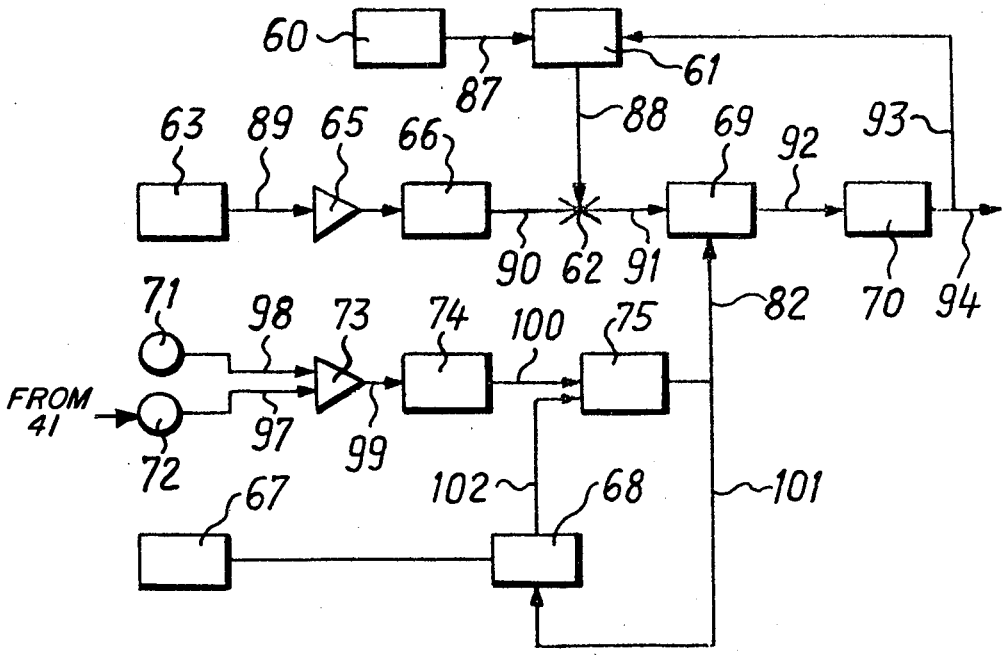
FIG. 7 is block diagram showing another embodiment of the control circuitry.

Located above a position where poured molds are brought out from under the tank 1, there is provided a sonic sensor 38 which operates to sonically measure the height 40 of a riser 105 in a finished mold such as the mold 26 after it has been poured. The measured value sensed by the sonic sensor 38 is transmitted in a known manner to an electronic control element 41 which as will be described in connection with FIG. 7 is connected to a control mechanism for correcting the quantity of molten metal to be poured in the pouring of the next mould, i.e., mould 25 in FIG. 2. In another embodiment of the invention, the riser height 40 may be sensed by a photocell 42 which is depicted in FIG. 2*a*.

Figure 5:
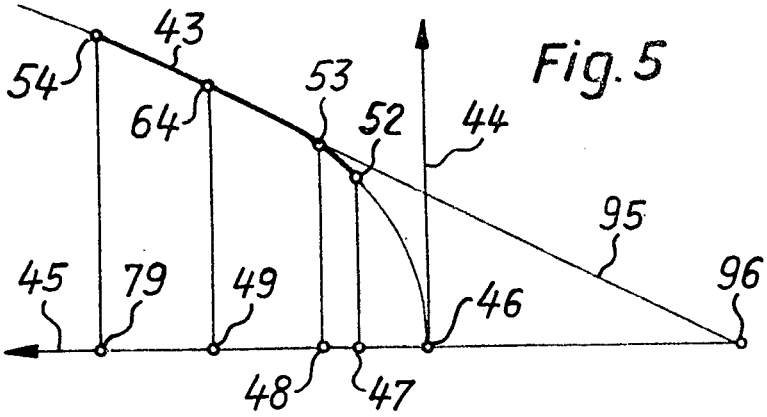
FIG. 5 is a graph showing a curve representing the ratio between the pressure head of liquid metal in a receptacle and the outflow velocity thereof.

FIG. 5 shows a curve 43 which depicts the well known relationship between the outflow velocity of the liquid metal and the pressure head thereof. Outflow velocity is represented along the ordinate 44 and the pressure head above the discharge opening 3 in the tank 1 is represented along the abscissa 45. Since the outflow velocity is proportional to the square root of the pressure head, the curve 43 is a parabola. The values of pressure head in the tank 1 are indicated at 46, 47, 48, 49 and 79 along the curve 43 and each of these points correspond, respectively, to liquid metal levels 23, 34, 50, 56 and 51 depicted in FIG. 3.

As depicted in curve 43, an outflow velocity of value 52 corresponds to a pressure head of value 47. Other relationships will be apparent from the graph of FIG. 5. For example, outflow velocity 53 corresponds to pressure head 48, 64 corresponds to 49, and 54 corresponds to 79.

Experience has shown that the slag formation occurs on the surface of the liquid metal. Therefore, care must be taken in the operation of the pouring mechanism to ensure that, on the one hand, the amount of liquid metal 2 in the tank 1 does not recede below a minimum level indicated at 50 because the slag above the liquid metal may partially or completely clog the bottom opening of the tank 1 when the tank is allowed to run completely empty. On the other hand, the amount of liquid metal 2 must not exceed the maximum level 51 since the metal entering the interval 55 between the plug 4 and the tank 1 can solidify thereby making operation of the plug impossible.

Level 56 represents an average liquid metal level during operation. Since the levels suitable for operation will fall between levels 50 and 51, only the part of the curve 43 between the pressure head values 48 and 79 is of interest with regard to further considerations involved in the description herein. The point 53 on the curve 43 represents the minimum outflow velocity and the point 54 represents the maximum outflow velocity of the liquid metal during operation, in view of the considerations discussed above.

In the operation of the apparatus of the present invention the molds 22, 25, and 26 are passed beneath the tank 1 in the manner previously described. The molds move in the direction of the arrow 28 shown in FIG. 2, and the mold 26 is shown in the post-pouring position. When the molds 22, 25 and 26 reach the end of the travel in the direction of arrow 28, a switch (not shown) is operated by the displacement drive of the molds at the end of their displacement path and by operation of the switch there occurs a reversal of the position of the cylinder 33 by means of the valve thereby tipping or rotating pouring spout 29 from the raised position 34 into position 80 in which the spout bears upon the mold in the pouring position, in the case of FIG. 2 this being the mold 25.

Figure 2:
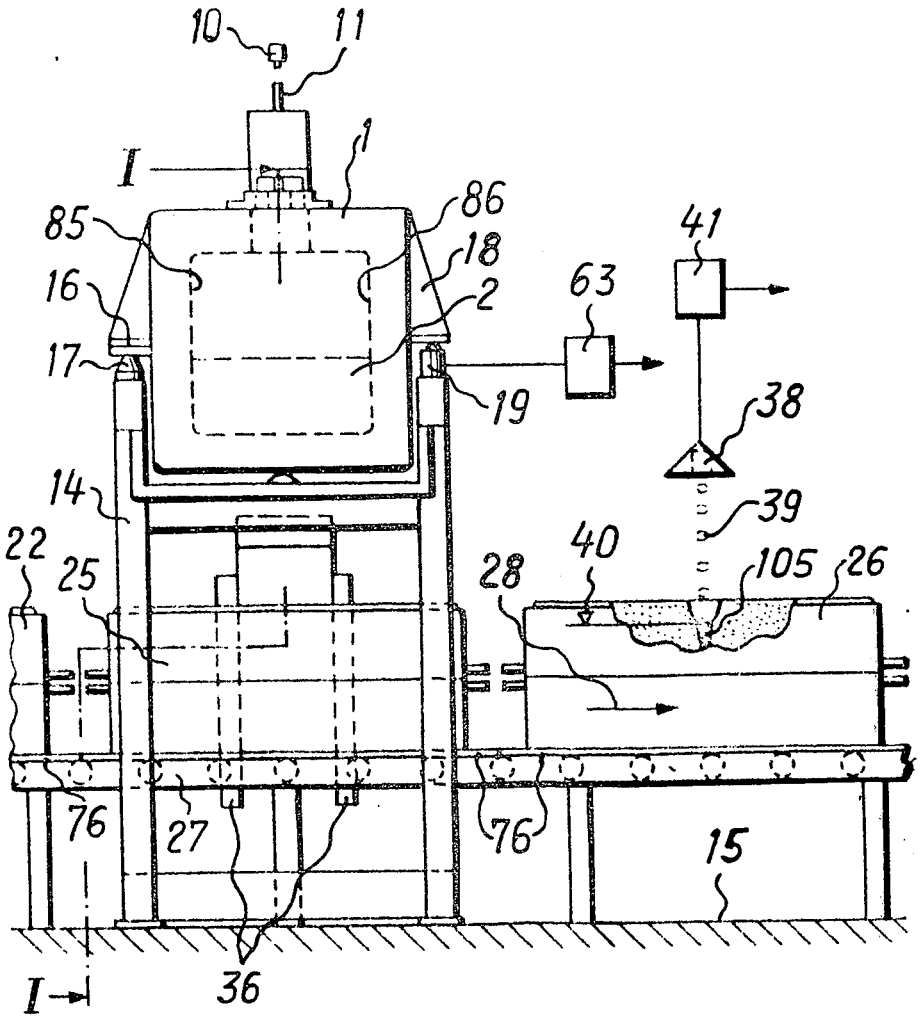
FIG. 2 is an elevation of the apparatus as viewed in the direction of an arrow II shown in FIG. 1.
Figure 2A:
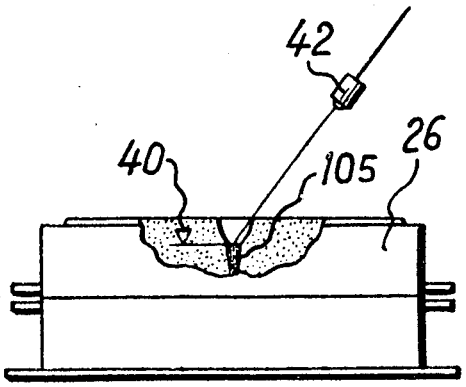
FIG. 2*a* is a detailed elevational view, partially in section, showing an alternative embodiment of the present invention.
Figure 3:
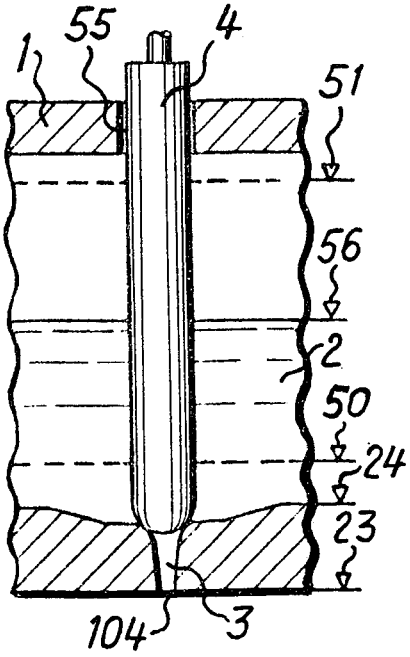
FIG. 3 is a sectional view showing a detail of a portion of the apparatus depicted in FIG. 1 on an enlarged scale.

At the same time, the valve 7 is actuated or reversed by another switch (not shown) over line 77 so that the valve 7, line 8, the lifting gear 5 all receive compressed air through pressure line 6 in order to raise the plug 4 from its lowermost position shown in FIGS. 2 and 3 into the position corresponding to that shown in FIG. 1.

As a result of the lifting of plug 4, the bottom opening 3 is open so that pouring of the mold as described above may be initiated. By means of electronic control equipment, whose mode of operation will be hereinafter described in greater detail, the pouring operation is completed by reversing the position of the valve 7, lowering the lifting gear 5 and closing the bottom opening 3 by operation of the plug 4 as shown in FIG. 3. Subsequently, valve 7 is likewise reversed to operate cylinder 33 and spout 29 is lifted from position 80 into the raised position 34. When spout 29 reaches the position 34, the displacement drive of the molds is started thereby moving the entire mold row by one mold division in the direction of the arrow 28. The working cycle thus commences once again.

Figure 6:
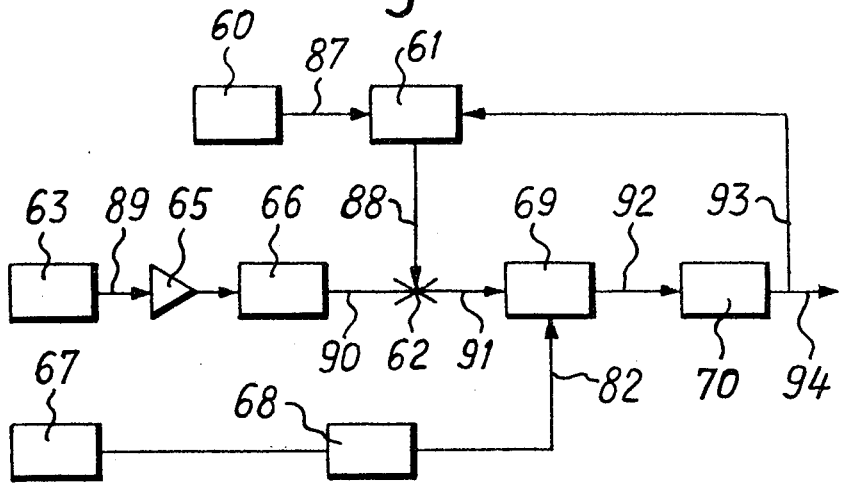
FIG. 6 is a block diagram showing electronic apparatus for controlling the opening time of the pouring means or bottom opening of the receptacle containing the liquid metal.

The electronic control means of the present invention shown in the block diagram of FIG. 6 includes as a central control element a counter 69 which is preferably designed as a reversible counter. Before the system of the invention is started, a pulse memory register 68 is set by a manually operated presetting device 67 to a number of pulses corresponding to the amount of liquid metal per mold at a given cross-section of opening 3. The counter or reversible counter 69 is thus likewise set to this number of pulses or value through a connecting line 82. If, when the system is first started, it is found that this value is not accurate in that the height 40 of the riser 105 of the mold deviates from a given height, it may be corrected by the presetting means 67. The reading of the electronic control 41 of balance 19 must be so balanced that when the tank is empty, a weight is indicated which will correspond to a falling height of tank 1 on the order of the difference of height 23 to bottom height 24. This ensures that the measured value of the electronic control 41 of balance 19 is proportional to the pressure head above bottom opening 3.

When the bar 11 actuates the switch 10 at the start of the casting operation by lifting the plug 4, since the function of the switch 10 is designated at 60, the start-stop logic 61 is actuated over a connecting line 87 and a logic element in the form of gate circuit 62 activated over connecting line 88 so that gate circuit 62 connects line 90 with line 91. The measured value of the electronic control 63 controls by means of a connecting line 89 a preamplifier 65 and, through connecting line 90, a voltage frequency transducer 66. Since it is desired to obtain from the measured value of balance 19 a predetermined quantity of molten metal poured and since such value measured is proportional to the pressure head, the voltage frequency transducer 66 is designed to generate pulses whose frequency is proportional to the square root of the measured value of the balance 19. Consequently the pulse frequency exactly represents the outflow velocity. These pulses are fed through connecting lines 90 and 91 to the counter 69 after the casting operation has started. When the value set in counter 69 is reached the start-stop logic is stopped by means of a connecting line 92, detector 70 and connecting line 93 and over line 94, valve 7 is switched to exhaust thus finishing the casting operation. When the start-stop logic 61 is stopped, gate circuit 62 is opened over connecting line 88. If the counter 69 is designed as a reversible counter and detector 70 as a zero counter, the control will be greatly simplified.

With the electronic control mechanism of FIG. 6, if the cross-section of the bottom opening 3 changes during the production period of the molds due to erosion or due to slag deposit or the like, the presetting means 67, and thus the setting of the pulse memory register 68, may be varied accordingly to compensate for the resulting increase or decrease of the specific rate of flow through opening 3.

The quantity of liquid metal may also be approximately controlled by effecting the control in accordance with a straight line 95 shown in FIG. 5. For this approximation method, the reading of the electronic control must be so balanced that, when the tank 1 is empty, a weight will be indicated which corresponds in FIG. 5 to the distance between the points 47 and 96, and the voltage frequency transducer 66 must generate pulses which are directly proportional to the value measured by the balance 19.

The second embodiment of the electronic control circuit of the present invention is depicted in the block diagram of FIG. 7. In this system, many of the elements shown are identical with elements in FIG. 6. For example, the functions of the elements identified by reference numerals 60, 61, 62, 63, 65, 66, 67, 69, 70, 82, 87, 88, 89, 90, 91, 92, 93, and 94 remain unchanged and are the same as in the block diagram in accordance with FIG. 6. They are therefore not again described in reference FIG. 7. FIG. 7 shows a control which automatically accounts for variations in the specific rate of flow of the liquid metal through the bottom of opening 3 during the pouring operation. The value of the sensor 38 is balanced over an electronic control 41, whose function is designated with 72 in FIG. 7, over connecting line 97, and the given nominal value 71 over connecting line 98 in a differential amplifier 73. The difference between these two signals is fed through a connecting line 99 to an analog-digital converter 74 and from there through connecting line 100 to an adder-subtractor 75 where it is increased or decreased corresponding to the balancing of the measured value from the analog-digital converter 74. This varied value is used to set counter 68 for pouring of the next mold. If the signal representing the height 40 of the riser 105 indicates that an amount less than that determined by nominal value 71 has occurred, the initial value of the counter 68 is increased. That is, the discharge time is extended correspondingly for the next casting operation and inversely it is shortened when the riser height 40 is too great.

FIGS. 6 and 7 show embodiments of the electronic control mechanism of the invention. The quantitative determination of the liquid metal during the casting is not, however, confined to these embodiments and the numerical integration can also be effected with other circuits.

The present invention allows simultaneous pouring of a large mold or several small molds over several closeable bottom openings 3 of a tank 1.

The determinations of the filling height of the tank containing a liquid metal is not confined to a weighing operation but it may also be effected, for example, with devices such as lasar beams over ceramic bodies which float on the liquid metal or over adjustable filling level indicators which work with isotopes.

While specific embodiments of the invention have been shown and described in detail to illustrate the application of the inventive principles, it will be understood that the invention may be embodied otherwise without departing from such principles.

I claim:

1. A method for pouring a mold with liquid metal to form a casting comprising the steps of locating over said mold a liquid metal receptacle having pouring means at the bottom thereof through which said liquid metal may be poured into said mold, continuously sensing the pressure head of said liquid metal in said receptacle during pouring of said mold, numerically integrating into a constant value the product of the multiplication of a function of the pressure head and time, and controlling the pouring means to terminate pouring of said mold when said value reaches a predetermined set value.

2. A method according to claim 1 wherein the square root of the pressure head is utilized as said function thereof.

3. A method according to claim 1 wherein after a mold has been poured the height of a riser of said poured mold is measured, with the height thereof being compared with a given standard height, with any deviations between the measured weight and said standard height being used to correct the set value for pouring of the following mold.

4. Apparatus for pouring liquid metal into a mold to form a casting comprising a liquid metal receptacle having pouring means in the bottom thereof through which said liquid metal may be poured into a mold located below said receptacle, means operatively associated with said receptacle for continuously sensing the pressure head of said liquid metal in said receptacle during the pouring of the mold, means connected with said continuously sensing means for numerically integrating to a constant value the product of the multiplication of a function of the pressure head and time, and means responsive to said numerically integrating means for controlling said pouring means to terminate pouring of said mold when said value reaches a predetermined set value.

5. Apparatus according to claim 4 wherein said continuously sensing means comprise a balance provided for determining said pressure head, said balance being comprised of a pressure cell.

6. Apparatus according to claim 4 wherein said pouring means comprises a bottom opening defined in said receptacle, said bottom opening being tapered towards the lower end thereof and being formed with its smallest cross section being at its discharge end.

7. Apparatus according to claim 4 wherein said pouring means comprise a bottom opening in said receptacle and a plug movable to open and close said bottom opening, said apparatus further comprising an electric switch located to be actuated by lifting and lowering of said plug in order to impart a start signal to said apparatus.

8. Apparatus according to claim 4 including electronic control means operatively associated with said continuously sensing means, and means interconnected between said continuously sensing means and said electronic control means for transmitting to said electronic control means a signal from said continuously sensing means, said electronic control means including, voltage-frequency transducer means (66) connected with said continuously sensing means, start/stop logic means (61) operatively associated with said voltage-frequency transducer means (66), counter means (69) connected to both said voltage-frequency transducer means (66) and said start/stop logic means (61), memory regulator means (68) connected with said counter means (69) and detector means (70) connected between said counter means (69) and said start/stop logic means (61).

9. Apparatus according to claim 8 wherein said start/stop logic means are also connected to receive a signal from said pouring means upon initiation of said pouring operation.

10. Apparatus according to claim 8 wherein said electronic control means include an actual value generator (72) operatively associated with molds poured from said receptacle for sensing the height of a riser of a poured mold, a nominal valve generator (71), a differential amplifier (73) having both said actual valve generator (77) and said nominal valve generator (71) connected thereto, an analog digital converter (74) having said differential amplifier (73) connected thereto, and an adder/subtractor (75) having said digital converter (74) connected thereto and with which a set value of said counter means (69) can be corrected, said actual value generator (72) and said nominal value generator (71) generating signals which are compared, with the difference therebetween operating to control said counter means (69).

11. Apparatus according to claim 4 further comprising means located in operative relationship with molds poured from said receptacle for determining the height of a riser of a mold after such mold has had said liquid metal poured thereinto.

12. Apparatus according to claim 11 wherein said means to determine the height of said riser comprise a sonic sensor located relative to said mold to be capable of sensing said height without direct contact with said mold.

13. Apparatus according to claim 11 wherein said means for sensing said height of said riser comprise photoelectric means including a photoelectric cell located in operative relationship to said mold.

* * * * *